US007548250B2

(12) United States Patent
Van Acquoij et al.

(10) Patent No.: US 7,548,250 B2
(45) Date of Patent: Jun. 16, 2009

(54) IMAGE-FORMING ELEMENT FOR A PRINTING APPARATUS WITH A MULTIPLEX CIRCUIT FOR DRIVING THE IMAGE-FORMING ELECTRODES

(75) Inventors: Catharinus Van Acquoij, Venray (NL); Rene J. Van Der Meer, Venlo (NL); Aart Nijkamp, Venlo (NL); Stanislaw K. J. Lenczowski, Waalre (NL); David D. L. Wijngaards, Tegelen (NL); Albert G. M. Van Welie, Baarlo (NL); Johannes G. V. Van Stiphout, Beek en Donk (NL)

(73) Assignee: OCE-Technologies B.V., Venlo (NL)

( * ) Notice: Subject to any disclaimer, the term of this patent is extended or adjusted under 35 U.S.C. 154(b) by 570 days.

(21) Appl. No.: 11/285,361

(22) Filed: Nov. 23, 2005

(65) Prior Publication Data

US 2006/0109333 A1 May 25, 2006

(30) Foreign Application Priority Data

Nov. 25, 2004 (EP) ..... 04106064

(51) Int. Cl.
*B41J 2/00* (2006.01)
*B41J 2/41* (2006.01)
*B41J 2/39* (2006.01)

(52) U.S. Cl. ..... 347/148; 347/112; 347/141

(58) Field of Classification Search ..... 347/141, 347/148, 112

See application file for complete search history.

(56) References Cited

U.S. PATENT DOCUMENTS 4,794,412 A 12/1988 Casey et al.
6,043,830 A 3/2000 Zur et al.

FOREIGN PATENT DOCUMENTS

EP 0 595 388 A1 5/1994
EP 0 803 783 A1 10/1997
EP 1 256 836 A2 11/2002

*Primary Examiner*—An H Do
(74) *Attorney, Agent, or Firm*—Birch, Stewart, Kolasch & Birch, LLP

(57) ABSTRACT

An image-forming element for a printing apparatus which includes a support structure with a plurality of electrodes of a first type disposed thereon and an electronic control unit for energizing the electrodes. The image-forming element further includes a plurality of electrodes of a second type, each one of said electrodes of the second type being arranged for interacting capacitively through a dielectric layer with a number of electrodes of the first type, forming a group, the electronic control unit containing a first series of drivers for energizing the electrodes of the first type, each one of said drivers being suited for energizing one electrode of the first type within each group and a second series of drivers for energizing individually the electrodes of the second type, the first and second series of drivers being arranged such that the electrodes of the first type can be individually activated, image wise.

9 Claims, 3 Drawing Sheets

IMAGE-FORMING ELEMENT FOR A PRINTING APPARATUS WITH A MULTIPLEX CIRCUIT FOR DRIVING THE IMAGE-FORMING ELECTRODES

BACKGROUND OF THE INVENTION

The present invention relates to an image-forming element for a printing apparatus including a support structure with a plurality of electrodes of a first type thereon and an electronic control unit for energizing electrodes.

An image-forming element of this type is usable as a so-called direct induction printer and is known from EP 0 803 783. In a direct induction printer, the image-forming electrodes on the surface of a drum body are covered by a dielectric layer, and a rotatable sleeve is disposed along the drum body such that the surfaces of the drum body and the sleeve form a gap which extends at right angles to the image-forming electrodes of the drum. A stationary magnetic knife is disposed inside of the sleeve for generating a magnetic field in the gap. A uniform layer of electrically conductive and magnetically attractable toner powder is applied to the surface of the sleeve. In an image-forming zone defined by the magnetic field in the gap, the toner powder is transferred onto the surface of the drum, depending on the voltage applied to the image-forming electrodes. Thus, by rotating the drum body and energizing the electrodes in accordance with image formation supplied to the control unit, a toner image is formed on the surface of the drum. Alternatively, a uniform layer of toner powder may be applied to the surface of the drum, and the toner powder may selectively be removed from the drum in accordance with the energizing pattern of the image-forming electrodes.

With the image-forming element of the prior art, the electronic control unit is provided with a number of electronic drivers for applying a voltage to each of the image-forming electrodes. Since each electrode is driven individually, one distinct driver is required for each image-forming electrode. For example, in the case of a printer with a resolution of 23.6 pixel per mm (600 dpi) and an image-forming element having a printing width of 300 mm, the number of drivers required for driving the image-forming electrodes is 7080. With the conventional image-forming elements, the manufacturing costs scale linearly with increasing print resolution or printing width. Moreover, when the number of drivers increases, the complexity of the manufacturing increases, due to the large number of interconnections required on a control unit.

SUMMARY OF THE INVENTION

The present invention seeks to provide an image-forming element for a printing apparatus including a support structure with a plurality of electrodes of a first type thereon and an electronic control unit for energizing electrodes in which the prior art problems are mitigated.

In accordance with the present invention, this object is accomplished in an image-forming element wherein the image-forming element further includes a plurality of electrodes of a second type, each one of said electrodes of the second type being arranged for interacting capacitively through a dielectric layer with a number of electrodes of the first type forming a group, the electronic control unit containing a first series of drivers for energizing the electrodes of the first type, each one of said drivers being suited for energizing one electrode of the first type within each group and a second series of drivers for individually energizing the electrodes of the second type, the first and second series of drivers being arranged such that the electrodes of the first type can be individually activated, image wise.

Thus, for a given resolution and print width, the number of drivers required for an image-forming element according to the present invention is less than in a conventional image-forming element. Thus, the production costs can be reduced and the ease of manufacturing increased.

In one embodiment of the present invention, an electronic element is electrically connected between each electrode of the first type and the driver of the first type driving said electrode for substantially blocking electrical currents depending on the polarity of the voltage applied to said electronic element. Such elements are useful to maintain the required electrical charges on the electrodes. For example, diodes or electrical switches can be used.

Preferably, the image-forming elements comprises means for discharging the electrodes of the first type. The electrodes of the first type can thus be conveniently discharged and charged again for an image-wise activation of the electrodes of the first type.

Preferably, the electrodes of the first type and the electrodes of the second type are extending parallel to the transport direction of an image receiving medium.

The present invention particularly provides an image-forming element wherein the electrodes of the first type and the electrodes of the second type are ring-shaped. With such embodiments, high resolution printing can be conveniently achieved.

The present invention also relates to an image printing apparatus including at least one image-forming element.

BRIEF DESCRIPTION OF THE DRAWINGS

The present invention will now be explained with reference to the following exemplified embodiments of the present invention, and illustrated by reference to the drawings, wherein.

DETAILED DESCRIPTION OF THE INVENTION

Figure 1:
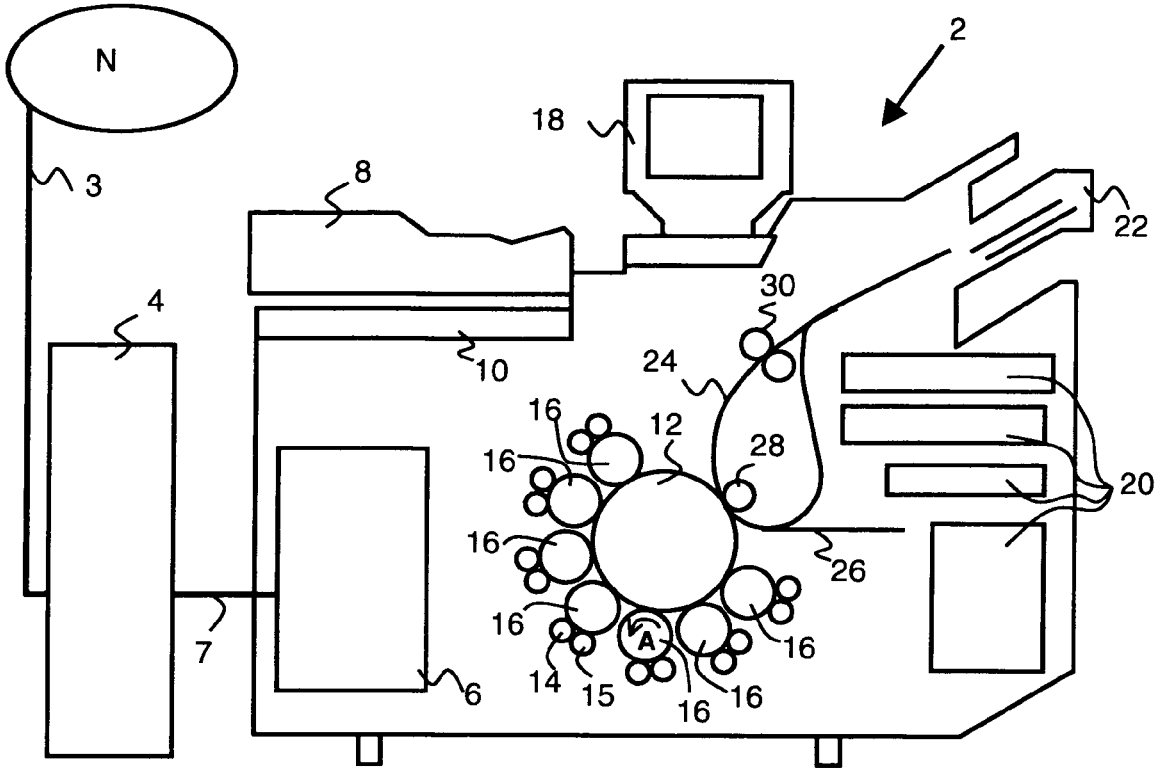
FIG. 1 is a schematic diagram of a printing apparatus using direct induction printing technique.

The printing apparatus includes a print engine 2 which is connected to a print server 4 suited for sending print jobs to the print engine 2 through a connection cable 7. The print server 4 is further connected to a network N, the connection being diagrammatically shown in the form of a cable 3. N may be a local area network that enables a number of users logged on client computers sending print jobs to the printer 2, or may represent the internet. The print server 4 receives print jobs from client computers, converts them in a format that can be processed by the print engine 2 and ensures in co-operation with an image processing unit 6 placed inside the print engine 2, that the digital images sent with the print jobs are printed on image supports.

The printing apparatus is provided with an automatic document feeder 8 for automatically feeding to a scanner unit 10 an original sheet or a stack of original sheets placed in the feeder. The scanner unit 10 is suited for optically scanning an original sheet fed thereto and for converting the optical information into electrical image signals by means of photoelectric sensors such as CCDs.

The printing apparatus also includes a user interface panel 18, provided with a display screen and a key panel. The user interface panel is connected to the image processing unit 6 and to the print server 4 and is suited for selecting a user, setting queuing parameters, changing job attributes, and the like.

Figure 2:
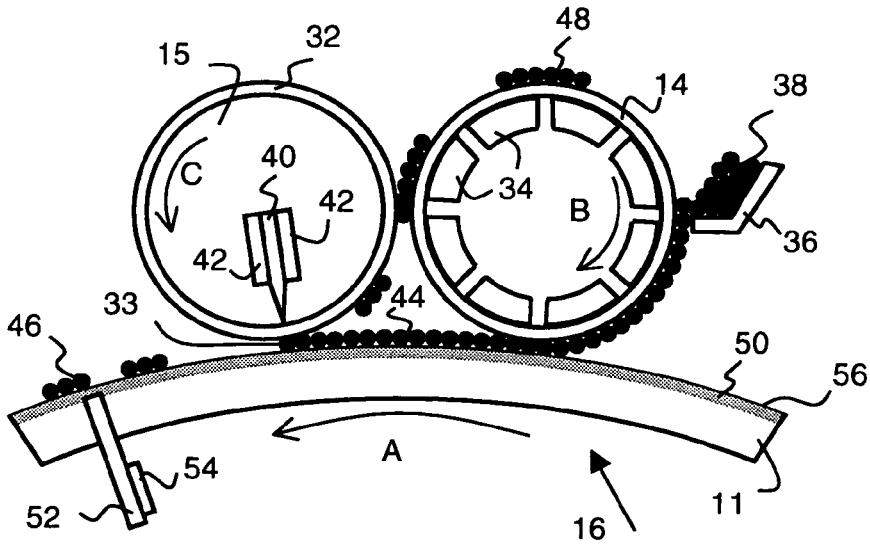
FIG. 2 is a schematic diagram of an image forming station.

The principle of image formation is now explained with reference to FIGS. 1 and 2. The print engine contains a number of image-forming elements 16. Each image-forming element includes a rotating drum 11 which can be driven in the direction of the arrow A by suitable driver means (not shown). For printing color images, a plurality of image-forming elements is used, each of said elements being supplied with toner in a specific color like cyan, magenta, yellow, red, blue, green or black for forming a separation image. Each image-forming element 16 is provided with a number of energizable image-forming electrodes 50 placed beneath a dielectric layer 56. The electrodes 50 are placed at a given distance from each other which determines the axial resolution of the print system, for example 600 dpi. The magnetic roll 14 (which can be driven in the direction of the arrow B) and the developing unit 15 provided with a rotating sleeve 32 (which can be driven in the direction of the arrow C) are part of an image-forming station as shown in FIG. 2. Conductive and magnetically attractive toner powder 38 is supplied to the magnetic roll 14 by a toner supplying unit 36. By applying a predefined bias voltage to the magnetic roll 14 with a number of magnets 34, a uniform layer 44 of toner powder is applied to the outer surface of the image forming element 16. A soft-iron knife 40 is disposed inside of the developing unit 15 and is placed between two magnets 42 in contact with the knife by poles of the same sign for generating a magnetic field in the gap 33. In order to develop a toner image on the image-forming element 16, the electrodes 50 placed on the outer circumferential surface of the drum 11 are activated, image-wise by means of drivers 54 placed on an electronic control unit 52, being for example a driver board. According to the image line to be printed, the ring electrodes retain an activation pattern, i.e., an electrical potential pattern in accordance with image information supplied by the image processing unit 6. In an image-forming zone defined by the magnetic field in the gap, the toner powder is selectively removed from the surface of the image-forming element 16, depending on the activation pattern on the ring electrodes. A predefined bias voltage $V_B$ is applied to the rotating sleeve 32, for example 40V. If a given electrode is activated in such a way that it is brought to an electrical potential equal to $V_B$, the toner is removed from the image-forming element 16 by the rotating sleeve 32 since the magnetic forces exerted on the toner particles by the magnetic field in the gap 33 then overcome the electrostatic forces. The removed toner 48 is transported back by the rotating sleeve 32 to the magnetic roll 14. On the contrary, if a given electrode is activated in such a way that it is brought up to an electrical potential equal to $V_A$, for example 80 V, the toner remains adhered to the surface of the image forming element 16 since the electrostatic forces overcome the magnetic forces exerted on the toner particles by the magnetic field in the gap 33. The developed toner 46 forms a part of a separation image.

Image resolution in the tangential direction, i.e., in the direction of the arrow A, is determined by the duration of the voltage applied to the electrodes. It is also influenced by the shape of the magnetic field in the gap 33.

A toner powder image, being a separation image, is thus formed on the surface of each image-forming element 16. Each separation image is then transferred successively by means of pressure contact with an image receiving medium, for example, a transfer drum 12 having a rubber surface. The complete color image is thus formed on the rubber surface and can be transferred and fused onto a print medium (for example a sheet of paper) by a suitable combination of pressure and temperature. The sheet of paper is conveyed from any of the paper trays 20 to the transfer drum by the guide track 26 and is then pressed between the transfer drum 12 and the pressure roll 28. The sheet of paper is then conveyed by the guide track 24 to the post fuser unit 30 and can undergo a duplex loop for printing on the reverse side, or can be directly output in the receiving tray 22.

Figure 3:
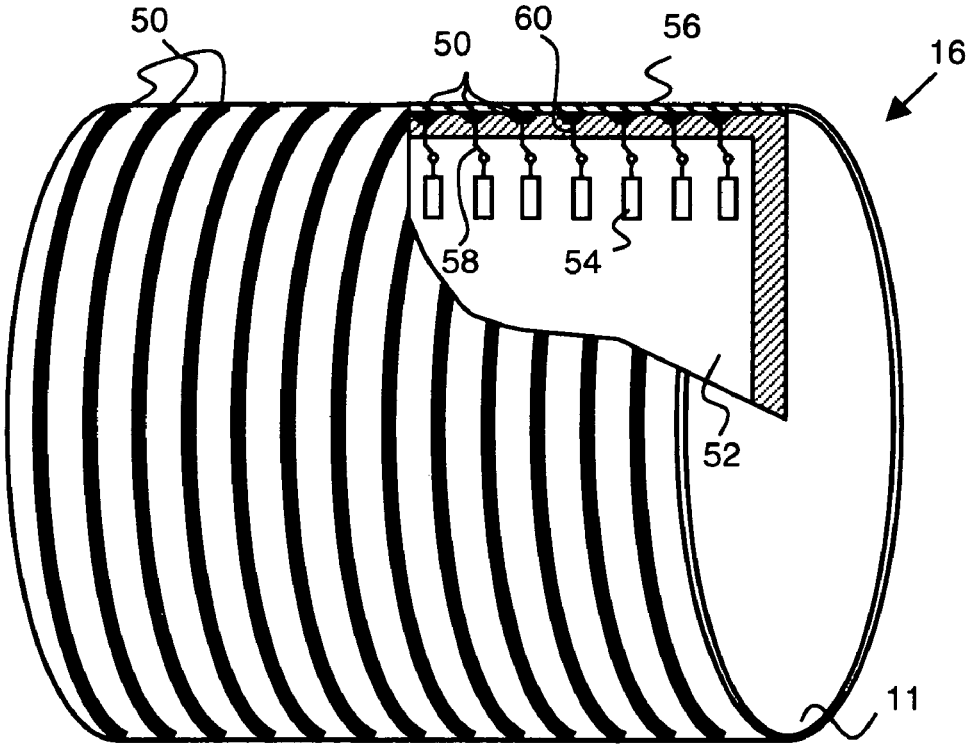
FIG. 3 is a schematic diagram of an image forming element according to the prior art.

The connections from the image-forming electrodes to the drivers of the electronic control unit 52 (driver board) is shown in more detail in FIG. 3, representing schematically an image forming element according to the prior art. The circumferential surface of the image-forming element 16 has a regular pattern of circular image-forming electrodes 50 extending in the circumferential direction. The widths and pitch of the electrodes 50 are greatly exaggerated in the drawing. In practice, each of the electrodes corresponds to a single column of pixels of the image to be formed on the surface drum of the image-forming element 16. When the image resolution of the print engine is 600 dpi, the electrode pitch is thus 42.3 μm. As is shown in the sectioned part of the drawing of the image-forming element 16, the electrodes 50 are placed on the outer surface of the rotating drum 11 and are covered by a layer of dielectric material 56. Each of the electrodes 50 is associated with one driver 54 which controls a voltage to be applied to the electrode. Each electrode 50 is connected to its associated driver 54 by a switch 58. A more detailed description of the structure and manufacture of the drum is shown in EP 595388.

Figure 4:
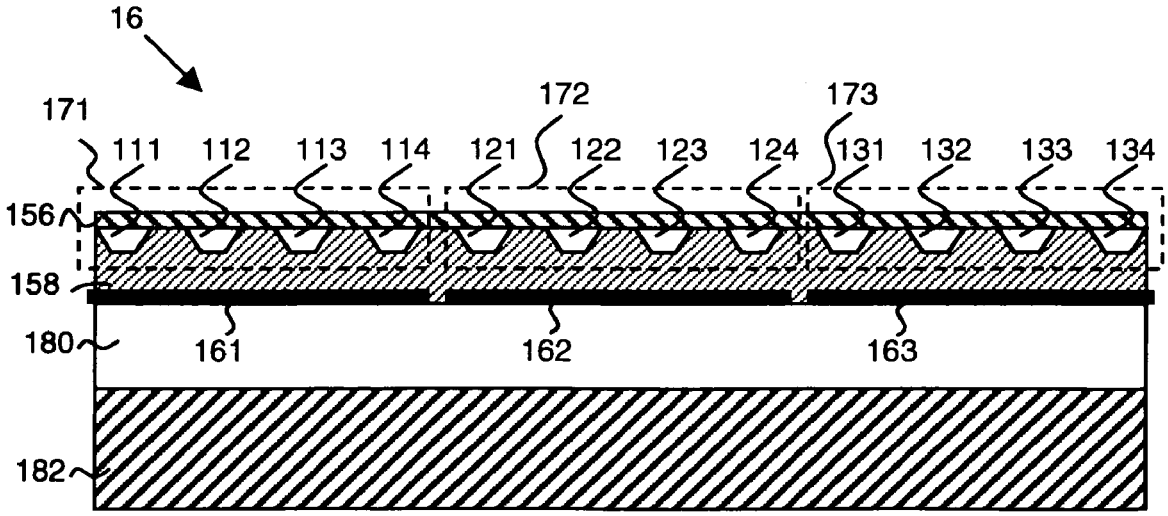
FIG. 4 is a schematic diagram of an image forming element according to an embodiment of the present invention.

In FIG. 4, a section of the structure of an image-forming element according to an embodiment of the present invention is shown. Note that the drawing is not to scale and that the electronic control unit is not represented therein. However, the image-forming element is provided with an electronic control unit for energizing the electrodes, said control unit being for example a driver board fastened to the support structure such that the drivers can be electrically connected to the electrodes. In practice, the shown structure extends in the longitudinal direction and repeats itself a great number of times. The image-forming element 16 comprises a support structure 182 which may be a metallic drum having a polished surface. During manufacturing, a number of layers is deposited on the surface of the support structure, such as dielectric layers and metallic layers, of which certain layers are structured according to well-known techniques. A dielectric layer 180 is provided on the surface of the support structure 182 and is electrically insulating the metallic drum from the so-called common electrodes of which only three (161, 162, 163) are shown in the drawing. The layer 180 may be made of an epoxy or any other electrical insulating material and has for example a thickness of 50 to 100 μm. The circumferential surface of the dielectric layer 180 has a regular pattern of circular common electrodes extending in the circumferential direction. Although only three common electrodes 161, 162, 163 are represented in FIG. 4, in practice, an image forming element according to the present invention includes a large number of common electrodes. A second dielectric layer 158 is provided above the common electrodes. The dielectric layer 158 has such properties that the common electrode 161 can interact capacitively through the dielectric layer 158 with a number of image-forming electrodes 111, 112, 113, 114 forming a group 171 represented by a dashed line. For the sake of clarity, the drawings show how four image forming electrodes are forming a group, the electrodes within each group being arranged for interacting capacitively with a common electrode. However, in practice, any number of image forming electrodes may be arranged group-wise for interacting with a given common electrode. A group 172, comprising the image forming electrodes 121, 122, 123, 124, is arranged such that said electrodes can interact capacitively through the dielectric layer 158 with the common electrode 162. Another group 173, containing the image forming electrodes 131, 132, 133, 134, is arranged such that said electrodes can interact capacitively through the dielectric layer 158 with the common electrode 163. The described configuration is repeated regularly a number of times in the longitudinal direction of the image forming element. In particular, the image forming electrodes form a regular pattern of circular electrodes extending in the circumferential direction.

Figure 5:
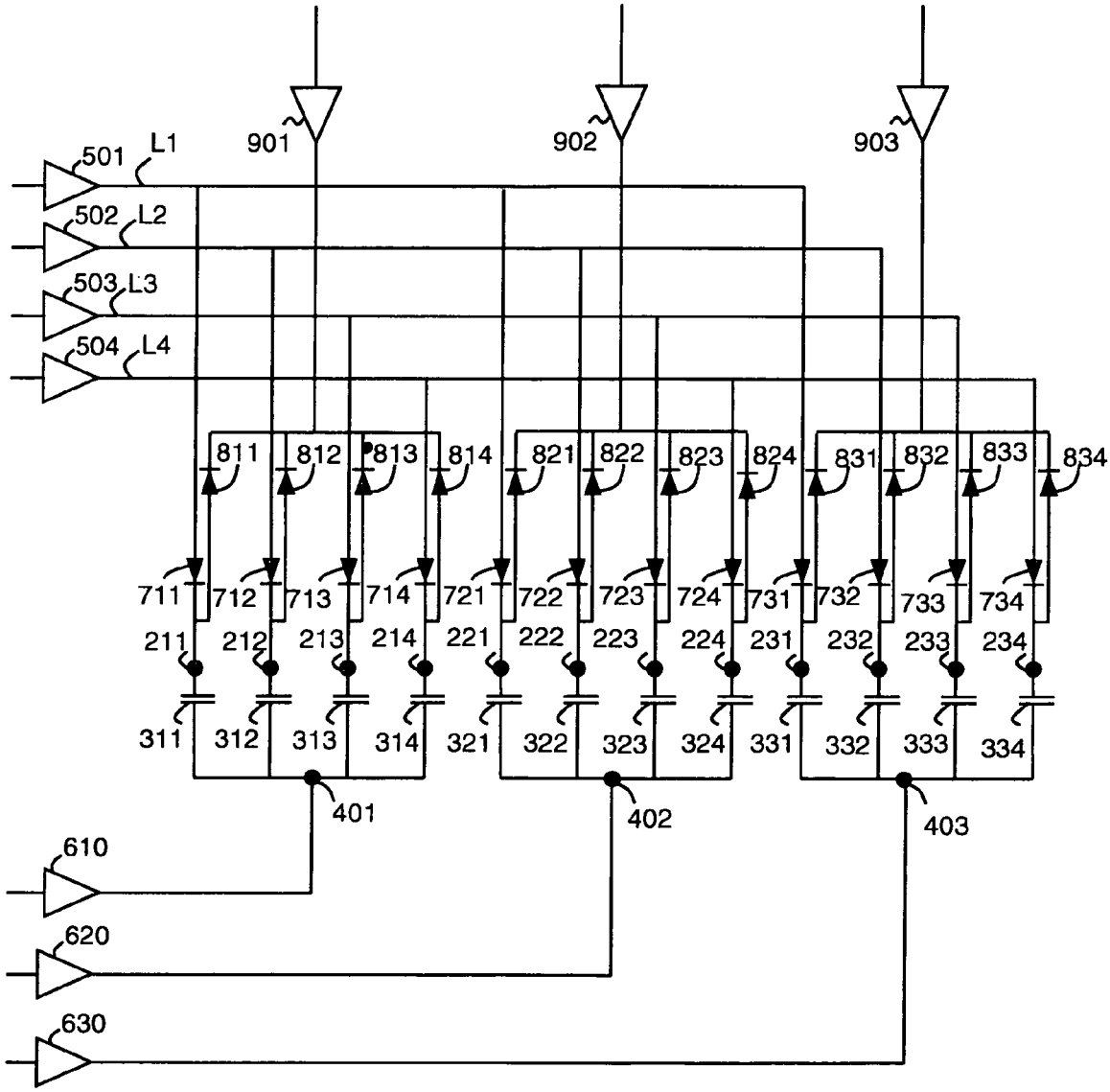
FIG. 5 is a schematic diagram of a replacement electrical circuit representing the electrical functions of an image forming element according to an embodiment of the present invention.

The image forming element 16 according to the present invention is provided with an electronic control unit for energizing the electrodes. The electronic control unit includes a first series of drivers for energising the image forming electrodes, each one of said drivers being suited for energizing one image forming electrode within each group and a second series of drivers for individually energizing the common electrodes. FIG. 5 is a schematic diagram of a replacement electrical circuit representing the electrical functions of a part of an image forming element according to the present invention. The points 401, 402 and 403, respectively, represent the common electrodes 161, 162 and 163 and are positions for indicating an electrical potential present on the respective common electrodes. The points 211, 212, 213 and 214 respectively represent the image forming electrodes 111, 112, 113 and 114 (group 171). The capacitors 311, 312, 313 and 314 represent the capacitive coupling between each electrode of the group 171 and the common electrode 161.

The points 221, 222, 223 and 224 respectively represent the image forming electrodes 121, 122, 123 and 124 (group 172). The capacitors 321, 322, 323 and 324 represent the capacitive coupling between each electrode of the group 172 and the common electrode 162.

The points 231, 232, 233 and 234 respectively represent the image forming electrodes 131, 132, 133 and 134 (group 173). The capacitors 331, 332, 333 and 334 represent the capacitive coupling between each electrode of the group 173 and the common electrode 163.

The electronic control unit includes a first series of drivers for energizing the image-forming electrodes, each one of said drivers being suited for energizing one image-forming electrode within each group whereby the image-forming electrodes within each group are arranged for interacting capacitively with a common electrode. A number of drivers 501, 502, 503 and 504 of the first series is represented in FIG. 5. The driver 501 is suited for energizing the image-forming electrodes connected to the line L1, i.e., the electrode 111 (represented by the point 211) of the group 171, the electrode 121 (represented by the point 221) of the group 172, the electrode 131 (represented by the point 231) of the group 173 and other electrodes of other groups not shown in FIG. 5.

The driver 502 is suited for energizing the image-forming electrodes connected to the line L2, i.e., the electrode 112 (represented by the point 212) of the group 171, the electrode 122 (represented by the point 222) of the group 172, the electrode 132 (represented by the point 232) of the group 173 and other electrodes of the groups not shown in FIG. 5.

The driver 503 is suited for energizing the image-forming electrodes connected to the line L3, i.e., the electrode 113 (represented by the point 213) of the group 171, the electrode 123 (represented by the point 223) of the group 172, the electrode 133 (represented by the point 233) of the group 173 and other electrodes of the groups not shown in FIG. 5.

The driver 504 is suited for energizing the image-forming electrodes connected to the line L4, i.e., the electrode 114 (represented by the point 214) of the group 171, the electrode 124 (represented by the point 224) of the group 172, the electrode 134 (represented by the point 234) of the group 173 and other electrodes of the groups not shown in FIG. 5.

The electronic control unit also includes a second series of drivers for energising individually the common electrodes. In FIG. 5, three drivers 610, 620 and 630 of the second series are shown. The driver 610 is suited for energizing the common electrode 161, represented by the point 401. The driver 620 is suited for energizing the common electrode 162, represented by the point 402. The driver 630 is suited for energizing the common electrode 163, represented by the point 403.

The drivers of the first series and the drivers of the second series are suited for energizing the electrodes and may be drivers of a well-known type. Each driver is connected in a known manner to a voltage source, not shown in FIG. 5. For example, the drivers of the first series are suited for outputting voltages up to $V_{D1}$, and the drivers of the second series are suited for outputting voltages up to $V_{D2}$. The values of $V_{D1}$ and $V_{D2}$ are dependent on the development process. In the following, an example is taken with $V_{D1}=V_{D2}=40$ V, but obviously, other values can be chosen.

The control unit is provided with an ASIC (not shown) for controlling the output voltage of the drivers.

The control unit is also provided with diodes 711, 712, 713, 714, 721, 722, 723, 724, 731, 732, 733, 734 arranged as indicated in FIG. 5. Each individual diode of this kind is arranged such that it is forward biased when the output potential of a driver of the first series to which the diode is connected is superior to the electrical potential on the image-forming electrode that can be driven by said driver of the first series. For example, the diode 711 is forward biased when the output potential of the driver 501 is superior to the electrical potential at the point 211, representing the electrode 111 that can be driven by the driver 501. Otherwise, the diode is reverse biased.

Image formation, i.e., activation of the image-forming electrodes depending on the image data to be printed is now explained. By image-wise activation of image-forming electrodes, is meant performing a number a steps that result in the image-forming electrodes retaining an electrical potential pattern in accordance with image information. Such steps are explained hereinafter. After such steps have been performed, the image-forming electrodes are said to be in an idle state and they are able to retain an electrical potential pattern in accordance with image information. As indicated above, the image-forming electrodes within each group are arranged for interacting capacitively with a common electrode. The groups of image-forming electrodes are activated sequentially. For example, the image-forming electrodes of the group 171 are activated image-wise, while the electrodes of the other groups 172 and 173 are in an idle state. In the example that follows, the group 171 is chosen to be the activated group, while the groups 172 and 173 are chosen to be idle. To achieve the activation of the group 171, the drivers are driven according to an adequate sequence of a number of steps.

At the beginning of image formation, for example after the printing apparatus has been switched on, all electrodes are at a zero electrical potential. A predefined bias voltage $V_B$ is then applied to the rotating sleeve 32, for example 40V.

In a first step, the driver 610 is not driven (zero output voltage), while the drivers 620 and 630 are driven to deliver an output voltage $V_{D2}$. The point 401 is at zero potential and consequently the points 211 to 214 remain at zero potential. The points 402 and 403 are at an electrical potential $V_{D2}$. Due to the fact that the capacitors 321 to 334 are not able to be charged because of the diodes 721 to 734 which are reverse biased, the points 221 to 234 carry the same potential $V_{D2}$. The image-forming electrodes of the groups 172 and 173 (idle groups) are thus at an electrical potential $V_{D2}$ while the image-forming electrodes of the group 171 (activated group) remain at zero potential.

In a second step, the drivers 501, 502, 503 and 504 are selectively driven, depending on the image to be formed on the image-forming electrodes 111, 112, 113, 114 (activated group). Let us suppose that the electrodes 111 and 112 have to be activated such that pixels are formed on the image receiving medium, while the electrodes 113 and 114 have to be activated such that no pixel is printed. To achieve this, the drivers 501 and 502 are driven to deliver an output voltage $V_{D1}$ while the drivers 503 and 504 remain at a zero output voltage. Since the output voltage $V_{D1}$ of the drivers 501 and 502 is superior to the zero electrical potential at the points 211 and 212, the diodes 711 and 712 let a forward current flow and the capacitors 311 and 312 become charged. This means that the electrical potential at the points 211 and 212 is now $V_{D1}$ while the potential at the point 401 is zero. The potentials at the points 213 and 214 remain zero. The potentials at the points 221 to 234 are not influenced by the driving of the drivers 501 to 504 due to the reverse bias of the diodes 721 to 734. Therefore, the potentials at the points 221 to 234 remain equal to $V_{D2}$.

In a third step, the driver 610 is driven to deliver an output voltage $V_{D2}$. The diodes 711 to 714 are now reverse biased, meaning that almost no current is flowing through them. The electrical potential $V_{D2}$ simply adds to the potential already present on the image-forming electrodes of the group 171, i.e., at the points 211 to 214. The potential at the points 211 and 212 is thus now $V_{D1}+V_{D2}=80$ V, while the potential at the points 213 and 214 is $V_{D2}$.

Some image-forming electrodes (111 and 112) of the activated group 171 have a potential equal to $V_{D1}+V_{D2}=80$ V while the other the electrodes (113 and 114) of the activated group 171 have a potential equal to $V_{D2}=40$ V. On all image-forming electrodes of the idle groups, the potential is $V_{D2}=40$ V. As indicated above by way of example, the toner is removed from the image forming element 16 by the rotating sleeve 32 if the image-forming electrode's potential is essentially equal to the bias voltage $V_B$ (40 V) of the rotating sleeve 32. On the contrary, the toner remains adhered to the surface of the image forming element 16 if the image-forming electrode's potential is large enough, for example 80 V. On such electrodes having a high electrical potential, toner is developed. In this way, pixels of a toner image can be formed on the image receiving medium.

After the group 171 has been activated, it becomes idle. The other groups are then sequentially activated. This implies that the group 172 is activated while the groups 171 and 173 are idle. Thereafter, the group 172 becomes idle. Then the group 173 is activated while the groups 171 and 172 are idle. And so on.

Let us now suppose that every group of image-forming electrodes has been activated once. Before a given group can be activated again, for example the group 171, a reset step is needed for this group.

For resetting purposes, the control unit is further provided with a number of reset drivers 901, 902, 903 and a number of diodes as indicated in FIG. 5: diodes 811, 812, 813, 814, 821, 822, 823, 824, 831, 832, 833 and 834. Each reset driver is suited for delivering an output voltage up to $V_R$, for example 80 V. The reset driver 901 is associated to the group of electrodes 171, the reset driver 902 is associated to the group of electrodes 172 and the reset driver 903 is associated to the group of electrodes 173. The diodes 811 to 814 are placed between the image-forming electrodes 111 to 114 (represented by the points 211 to 214), respectively, and the output of the reset driver 901 such that they are forward biased when the electrical potential at the point 211 or 212 or 213 or 214, respectively, is superior to the output voltage of the reset driver 901. The diodes 821 to 824 are placed between the image-forming electrodes 121 to 124 (represented by the points 221 to 224), respectively, and the output of the reset driver 902 such that they are forward biased when the electrical potential at the point 221 or 222 or 223 or 224, respectively, is superior to the output voltage of the reset driver 902. The diodes 831 to 834 are placed between the image-forming electrodes 131 to 134 (represented by the points 231 to 234), respectively, and the output of the reset driver 903 such that they are forward biased when the electrical potential at the point 231 or 232 or 233 or 234, respectively, is superior to the output voltage of the reset driver 903.

When all groups of image-forming electrodes are idle and retain an electrical potential activation pattern, all reset drivers deliver an output voltage equal to $V_R$, for example 80 V. The diodes 811 to 834 are thus reverse biased. Before an individual group is activated again, it has to leave its idle state and therefore, a reset step is performed for this group. Let us suppose that the group 171 of image-forming electrodes has now to leave its idle state. During a reset step, the output voltage of the reset driver 901 is set in this example to 40 V. Consequently, the diodes 811 to 814 become forward biased and the current can flow through the diodes 811 to 814. The image-forming electrodes 111 to 114 (group 171) can be discharged and the potential on each of the electrodes of the group 171 becomes zero. Afterwards, the output voltage of the reset driver 901 associated to the group 171 is set again to $V_R$.

During the time that the groups of image-forming electrodes are idle, the drivers 901, 902 and 903 deliver an output voltage equal to $V_R$ and the diodes 811 to 834 are reverse biased since the output voltage $V_R$ is larger or equal to the electrical potential at each one of the points 211 to 234. Therefore, no current can flow through the diodes 811 to 834 during the time that the groups are idle. It is noted that the charges accumulated on the image-forming electrodes of a given group are retained until a reset step is performed for said group of image-forming electrodes. During the time that the charges are retained on the electrodes, the toner can be developed and a line of an image can thus be formed on the image-receiving medium.

The invention being thus described, it will be obvious that the same may be varied in many ways. Such variations are not to be regarded as a departure from the spirit and scope of the invention, nad all such modifications as would be obvious to one skilled in the art are intended to be included within the scope of the following claims.

The invention claimed is:

1. Image-forming element for a printing apparatus which comprises a support structure with a plurality of electrodes of a first type disposed thereon and an electronic control unit for energizing electrodes, wherein the image-forming element further includes a plurality of electrodes of a second type, each one of said electrodes of the second type being arranged for interacting capacitively through a dielectric layer with a number of electrodes of the first type, forming a group, the electronic control unit containing a first series of drivers for energizing the electrodes of the first type, each of said drivers being suited for energizing one electrode of the first type within each group and a second series of drivers for individually energizing the electrodes of the second type, the first and second series of drivers being arranged such that the electrodes of the first type can be individually activated, image wise.

2. The image-forming element according to claim 1, wherein an electronic element is electrically connected between each electrode of the first type and the driver of the first type drives said electrode for substantially blocking electrical currents depending on the polarity of the voltage applied to said electronic element.

3. The image-forming element according to claim 2, wherein the electronic element is a diode.

4. The image-forming element according to claim 2, wherein the electronic element is an electrical switch.

5. The image-forming element according to claim 1, wherein the image-forming elements comprises means for discharging the electrodes of the first type.

6. The image-forming element according to claim 1, wherein the electrodes of the first type and the electrodes of the second type extend substantially parallel to the transport direction of an image receiving medium.

7. The image-forming element according to claim 6, wherein the electrodes of the first type and the electrodes of the second type are ring-shaped.

8. The image-forming element according to claim 1, wherein the support structure is endless.

9. An image printing apparatus comprising at least one image-forming element of claim 1.

* * * * *